US011454068B1

(12) United States Patent
Al-Oqaili et al.

(10) Patent No.: US 11,454,068 B1
(45) Date of Patent: Sep. 27, 2022

(54) PRESSURE-DAMPENING CASING TO REDUCE STRESS LOAD ON CEMENT SHEATH

(71) Applicant: SAUDI ARABIAN OIL COMPANY, Dhahran (SA)

(72) Inventors: Abdullah Hassan Al-Oqaili, Al Qatif (SA); Ahmad Mohammad Al-AbdulJabbar, Dammam (SA); Ali J. Shaikh, Al-Hufuf (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/209,896

(22) Filed: Mar. 23, 2021

(51) Int. Cl.
*E21B 17/10* (2006.01)

(52) U.S. Cl.
CPC ..... *E21B 17/1042* (2013.01)

(58) Field of Classification Search
CPC ..... E21B 17/00; E21B 17/1042
See application file for complete search history.

(56) References Cited

U.S. PATENT DOCUMENTS 2,230,626 A * 2/1941 Miller ..... E21B 17/00 138/140
2,907,351 A * 10/1959 Rohrback ..... E21B 17/00 269/254 R
3,763,935 A 10/1973 Perkins
RE28,152 E * 9/1974 Waters ..... E21B 36/00 166/57
3,882,937 A * 5/1975 Robinson ..... E21B 43/38 166/57
3,918,523 A * 11/1975 Stuber ..... E21B 33/14 166/292
4,139,024 A * 2/1979 Adorjan ..... F16L 59/08 428/69
4,693,313 A 9/1987 Stephenson et al.
5,564,413 A * 10/1996 Hori ..... E21B 17/00 138/110
6,224,112 B1 * 5/2001 Eriksen ..... E21B 17/06 285/3
6,848,505 B2 * 2/2005 Richard ..... E21B 33/14 166/292
7,337,841 B2 3/2008 Ravi
7,832,483 B2 * 11/2010 Trent ..... E21B 43/24 166/57
8,551,244 B2 10/2013 Le Roy-Delage et al.
2006/0124315 A1 * 6/2006 Frazier ..... E21B 43/14 166/332.8

(Continued)

OTHER PUBLICATIONS

International Search Report and Written Opinion issued in Application No. PCT/US2022/021580, dated Jun. 3, 2022 (13 pages).

*Primary Examiner* — Shane Bomar
(74) *Attorney, Agent, or Firm* — Osha Bergman Watanabe & Burton LLP

(57) ABSTRACT

A casing may have a tubular body formed by a wall extending axially from a first end to a second end, the tubular body having a bore therein throughout. The wall may radially extend from an inner surface of the tubular body to an outer surface of the tubular body. The wall may include a base layer and one or more secondary layers attached to the base layer. The one or more secondary layers may be a rubber or smart foam.

15 Claims, 14 Drawing Sheets

(56) References Cited

U.S. PATENT DOCUMENTS

| | | | | |
|---|---|---|---|---|
| 2010/0122821 | A1* | 5/2010 | Corre | E21B 33/1216 166/387 |
| 2011/0086941 | A1 | 4/2011 | Therond et al. | |
| 2018/0266192 | A1* | 9/2018 | Gosney | E21B 41/0035 |
| 2020/0354622 | A1 | 11/2020 | Sherman et al. | |

* cited by examiner

PRESSURE-DAMPENING CASING TO REDUCE STRESS LOAD ON CEMENT SHEATH

BACKGROUND

Fluids are typically produced from a reservoir in a formation by drilling a wellbore into the formation, establishing a flow path between the reservoir and the wellbore, and conveying the fluids from the reservoir to the surface through the wellbore. Typically, a section of the wellbore is drilled at a time; then a casing is lowered into the wellbore and cemented before drilling the next section.

A casing profile includes multiple casing strings, such as conductor casing, surface casing, intermediate casing and production casing. Furthermore, each casing string undergoes a cement job. The large-diameter conductor casing protects shallow formations from contamination by drilling fluid and helps prevent washouts involving unconsolidated topsoil and sediments. Surface casing, the second string, has a smaller diameter, maintains borehole integrity and prevents contamination of shallow groundwater by hydrocarbons, subterranean brines and drilling fluids. The intermediate casing isolates hydrocarbon-bearing, abnormally pressured, fractured and lost circulation zones, providing well control as engineers drill deeper. Multiple strings of intermediate casing may be required to reach the target producing zone. The production casing, or liner, is the last and smallest tubular element in the well. It isolates the zones above and within the production zone and withstands all of the anticipated loads throughout the well's life.

With the wellbore lined with a casing, cement operations may be conducted. Cement operations include the process of mixing a slurry of cement, cement additives and water and pumping it down through casing to critical points in the annulus around the casing or in the open hole below the casing string. Cement supports and protects well casings and helps achieve zonal isolation. Critical to safer, environmentally sound, and profitable wells, zonal isolation is created and maintained in the wellbore by the cementing process. The cement is deigned based on various well parameters, e.g., depth, wellbore geometry, temperature, pressure, and formation composition.

If the cement fails to achieve zonal isolation, the failure may cause several potential risks such as a surface blowout, sustain casing pressure event, and/or downhole communication between zones. There are several factors that may result in a cement failure such as cyclic loads that are imposed on the cement. The increase in cyclic loads on the cement may be driven from hydraulic fracturing operations. Additionally, temperature cycling due to different fluid being injected or produced within the wellbore may also cause cement failure. If repeated loads with high magnitudes are exposed to the cement sheath, the cement may crack. To mitigate cementing crack, the cement mechanical properties may be enhanced. However, enhancing the cement mechanical properties is limited by the brittleness of the cement.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a casing having a tubular body formed by a wall extending axially from a first end to a second end, the tubular body having a bore therein throughout. The wall may radially extend from an inner surface of the tubular body to an outer surface of the tubular body. The wall may include a base layer and one or more secondary layers attached to the base layer. The one or more secondary layers may be a rubber or smart foam.

In another aspect, embodiments disclosed herein relate to a casing string. The casing string may include a first casing coupled to a second casing, with the first casing is axially below the second casing. The first casing may include a first tubular body formed by a first wall extending axially from a first end to a second end, the first tubular body having a first bore therein throughout. The first wall may radially extend from a first inner surface of the first tubular body to a first outer surface of the first tubular body. The first wall may include a first base layer and one or more first secondary layers attached to the first base layer. The one or more first secondary layers may be a rubber or smart foam. The second casing may include a second tubular body formed by a second wall extending axially from a third end to a fourth end, the second tubular body having a second bore therein throughout. The second wall may radially extend from a second inner surface of the second tubular body to a second outer surface of the second tubular body. The second wall may include a second base layer and one or more second secondary layers attached to the second base layer. The one or more second secondary layers may be a rubber or smart foam. Additionally, the casing string may include a collar or coupling configured to couple the second end of the first casing to the third end of the second casing In yet another aspect, embodiments disclosed herein relate to a method. The method may include forming a base layer of a tubular body extending axially from a first end to a second end. The method may also include providing one or more voids within the base layer. The one or more voids may be an empty space extending a radially distance between a first interior surface of the base layer and a second interior surface of the base layer. The method may further include embedding one or more secondary layers within the one or more voids, the one or more secondary layers may be a rubber or smart foam.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, shapes of the elements as drawn are not necessarily intended to convey any information regarding the actual shape of the elements and have been solely selected for ease of recognition in the drawing.

DETAILED DESCRIPTION

Figure 1A:
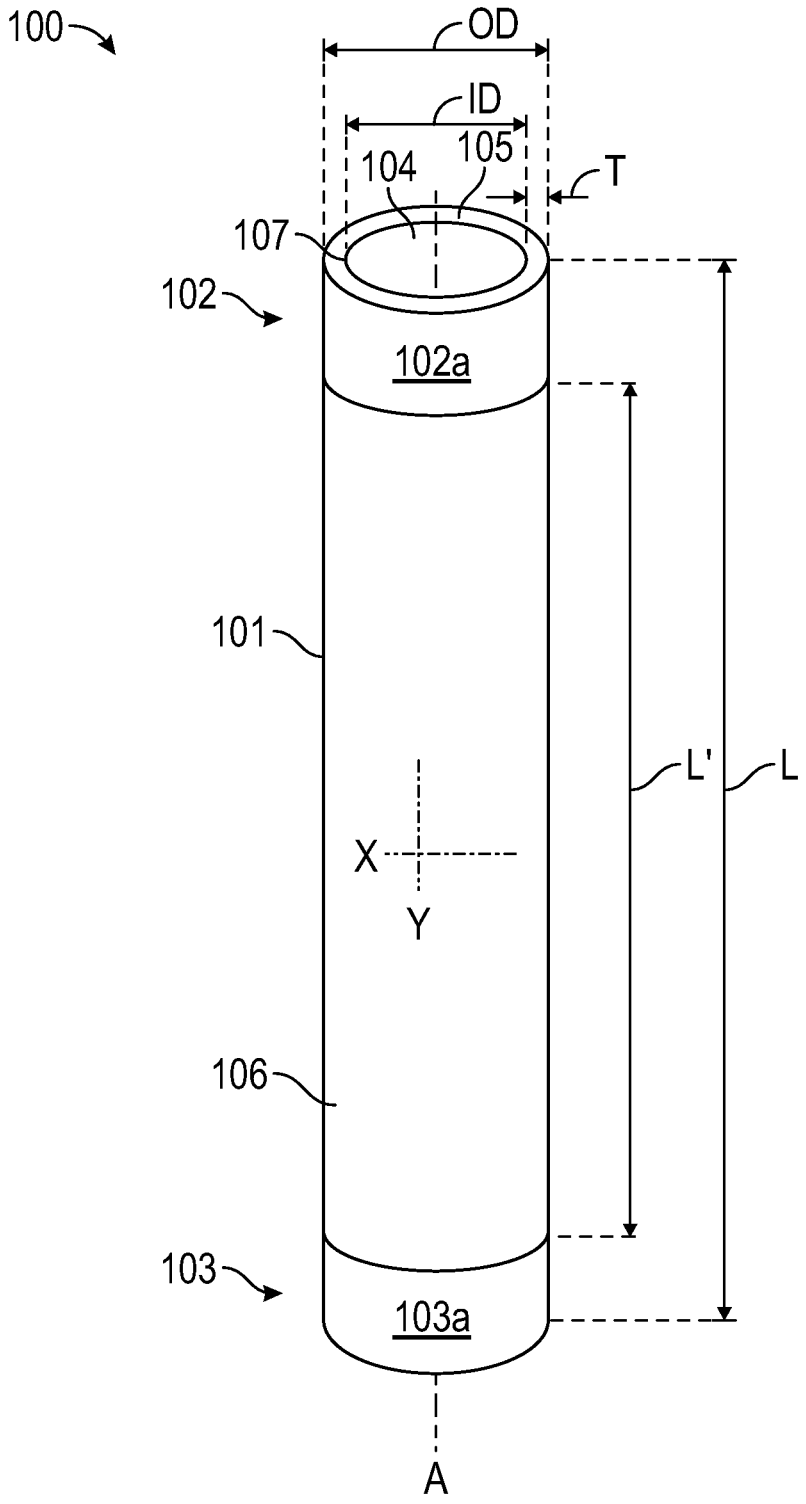
FIG. 1A is a schematic diagram of a casing in accordance with one or more embodiments disclosed herein.

In the following detailed description, certain specific details are set forth to provide a thorough understanding of various disclosed implementations and embodiments. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures. As used herein, the term "coupled" or "coupled to" or "connected" or "connected to" "attached" or "attached to" may indicate establishing either a direct or indirect connection, and is not limited to either unless expressly referenced as such. As used herein, fluids may refer to slurries, liquids, gases, and/or mixtures thereof. It is to be further understood that the various embodiments described herein may be used in various stages of a well (land and/or offshore), such as rig site preparation, drilling, completion, abandonment etc., and in other environments, such as work-over rigs, fracking installation, well-testing installation, oil and gas production installation, without departing from the scope of the present disclosure. Further, embodiments disclosed herein are described with terms designating orientation in reference to a vertical wellbore, but any terms designating orientation should not be deemed to limit the scope of the disclosure. For example, embodiments of the disclosure may be made with reference to a horizontal wellbore. It is to be further understood that the various embodiments described herein may be used in various orientations, such as inclined, inverted, horizontal, vertical, etc., and in other environments, such as sub-sea, without departing from the scope of the present disclosure. The embodiments are described merely as examples of useful applications, which are not limited to any specific details of the embodiments herein.

Embodiments disclosed herein are described with designated terms in reference to a tubular, but any designated terms should not be deemed to limit the scope of the disclosure. For example, the tubular string is made up of numerous tubular pipes joined end-to-end, and each of the tubular pipes might be about twenty to forty feet in length. Further, the tubular pipes are hollow and thus provide a continuous channel of communication between the drill rig and the bottom of the wellbore, down through which a suitable fluid can be introduced to any region required within the well. It is to be further understood that the various embodiments described herein may be used with various types of tubulars, including but not limited to casing, without departing from the scope of the present disclosure. A casing generally refers to a large-diameter pipe that is lowered into an openhole and cemented in place.

More specifically, embodiments disclosed herein are directed to a casing with one or more secondary layers. The one or more secondary layers may be referred to interchangeably as one or more protective layers. The one or more protective layers may be selected based on an annular clearness in a well design and casing rating requirements in a casing string. The different embodiments described herein may provide a casing with one or more secondary layers exhibiting elastic properties that plays a valuable and useful role in the life of a well. By using the casing with the one or more secondary layers having elastic properties, the casing may stretch without damaging the cement and dampen an effect of surface pressure on the casing. It is further envisioned that software simulations may be used to determine the number of secondary layers to dampen effects of pressure cyclic events on the casing. One skilled in the art will appreciate how the casing with the one or more secondary layers may be provided in a portion of a casing string that is exposed to pressure cyclic events during the life of a well. Further, a configuration and arrangement of the one or more secondary layers to provide a shield for the cement from an expansion and contraction of the casing may provide a cost-effective alternative to conventional systems used in cement operations. For example, one or more embodiments described herein may reduce a transition of a stress load to cement from the casing and eliminate cement cracking. The casing with the one or more secondary layers may increase a well-life of the cement in a wellbore. Additionally, the casing with the one or more secondary layers may provide better and longer well integrity by decreasing the chance of having non-productive time (NPT) and increase zonal isolation in the wellbore. Further, the casing with the one or more secondary layers may also insulate temperature transitions in the cement. Overall, the casing with the one or more secondary layers may minimize product engineering, risk associated with well blowouts, reduction of NPT, hardware cost reduction, and weight and envelope reduction. Thus, the disclosed casing improves safety on site and reduces cost associated with cement operations. The embodiments are described merely as examples of useful applications, which are not limited to any specific details of the embodiments herein.

Referring to FIG. 1A, a casing 100 in accordance with embodiments disclosed herein is illustrated. The casing 100 may have a tubular body 101 extending axially a length L from a first end 102 to a second end 103. The tubular body 101 may include a bore 104 extending therein from the first end 102 to the second end 103 about an axis A. By including the bore 104, the tubular body 101 may have a wall 105 with a thickness T extending radially between an outer diameter (OD) of the tubular body 101 and an inner diameter (ID) of the tubular body 101. The wall 105 may be delimited in an axial plane Y by the first end 102 and the second end 103 and delimited in a radial plane X by an outer surface 106 of the tubular body 101 and an inner surface 107 of the tubular body 101. Additionally, the first end 102 may include a first joint connection 102*a* and the second end 103 may include a second joint connection 103*a*. In a non-limiting example, the joint connections 102*a*, 103*a* may be a threaded connection to connect the casing 100 to a second casing (not shown) to form a casing string. In some embodiments, the threads of each joint connections 102*a*, 103*a* may be male threads. The threads may be a buttress thread or a round thread or a specialty thread. A collar or coupling (not shown), formed by a short cylindrical pipe that is slightly larger than the outer diameter OD of the casing 100, may include female threads to connect to the male threads of one casing to another casing. It is further envisioned that one of the joint connections 102*a*, 103*a* may be used to connect the casing 100 to a linear hangar or wellhead.

Figure 1B:
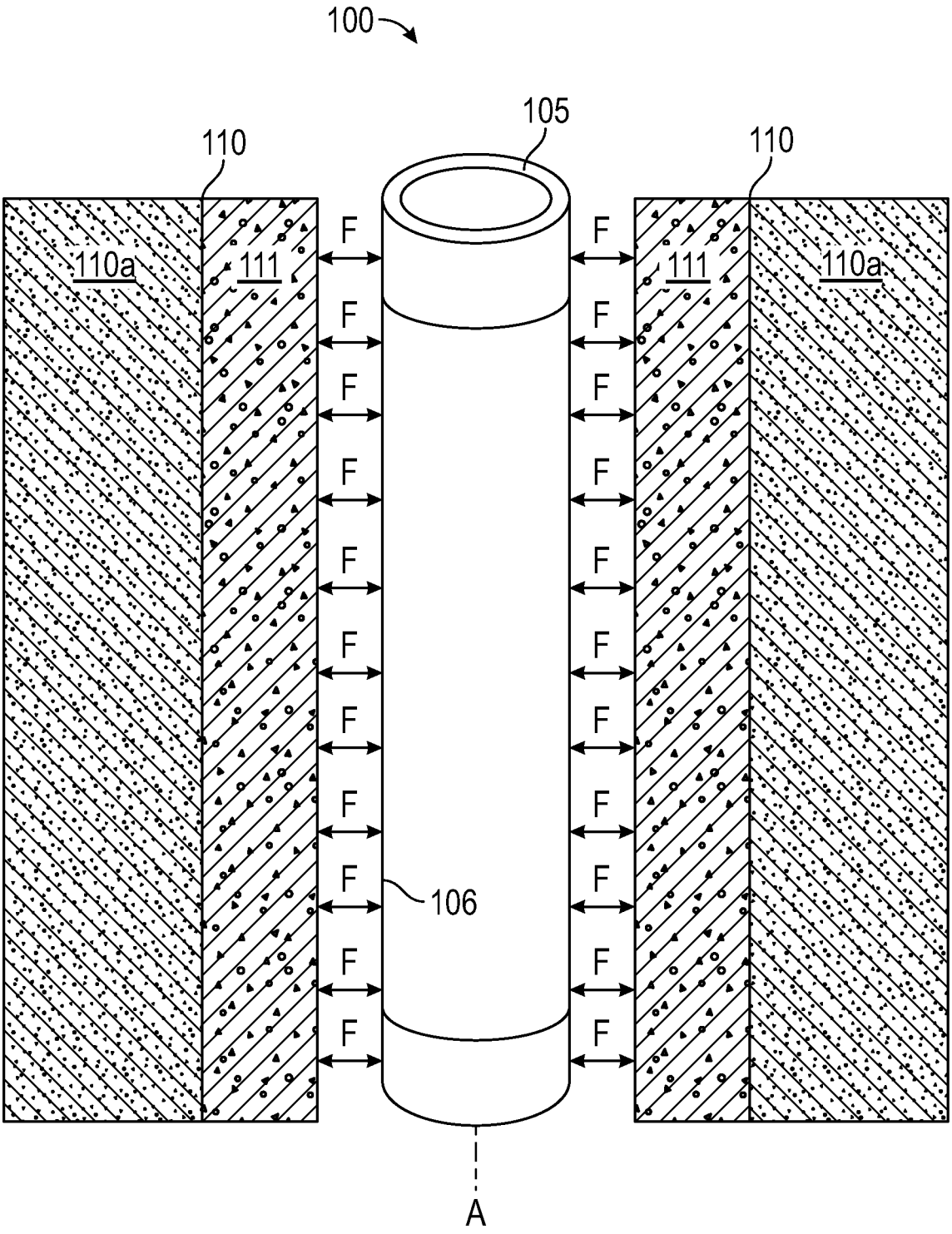
FIG. 1B is a schematic diagram of a casing within a wellbore in accordance with one or more embodiments disclosed herein.

In one or more embodiments, the tubular body 101 a second length L' extending between the joint connections 102*a*, 103*a*. The second length L' may be shorter than the length L. Additionally, the outer surface 106 of the tubular body 101 between the joint connections 102*a*, 103*a* may be exposed to cement and a formation within a wellbore. As shown by FIG. 1B, the casing 100 may be lowered into a wellbore 110 drilled within a formation 110*a*. In some embodiment, cement 111 may be pumped into the wellbore 110 to form a cement layer between the casing 100 and the formation 110*a*. The cement 111 may cement the outer surface 106 of the casing 100 to the wellbore 110. The casing and the cement 111 may apply various forces (see arrows F) on each other through the life of the well. While it is noted that a gap is shown between the casing 100 and the cement 111, this gap is merely shown to easily illustrate the arrows F between the casing 100 and the cement 111, and this gap may or may not exist without departing from the scope of the present disclosure.

In one or more embodiments, within the second length L', the tubular body 101 may include one or more secondary layers as described in the various embodiments of FIGS. 2A-6. While it is noted that FIGS. 2A-6 illustrate various embodiments, the various embodiments may be used in any combination with each other without departing from the scope of the present disclosure.

Figure 2A:
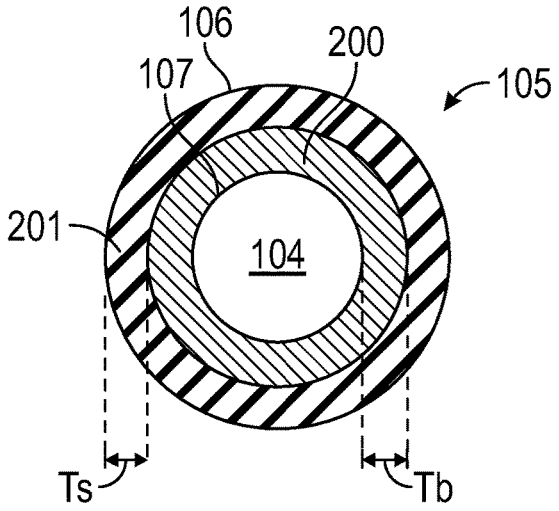
FIGS. 2A-2D are various cross-sectional views of casing of FIG. 1A in accordance with one or more embodiments disclosed herein.

In FIG. 2A, a cross-sectional view taken along a radial plane X in FIG. 1A is illustrated in accordance with a first embodiment. In other words, FIG. 2A shows a top view of the casing of FIG. 1A. As shown, the wall 105 may include a base layer 200 extending a thickness Tb radially outward from the inner surface 107 of the tubular body 101. The base layer 200 forms the bore 104. The base layer 200 may be made from a material selected from iron, steel, stainless steel, metal alloy, plastic (e.g., polyvinyl chloride (PVC)), or any material suitable for downhole conditions in a well. Additionally, the wall 105 may include a secondary layer 201 extending a thickness Ts radially outward from the base layer 200 to the outer surface 106. The thickness Tb and the thickness Ts added together form the thickness T of the wall 105. In some embodiments, the thickness Tb may be equal to, less than, or more than the thickness Ts. It is further envisioned that a thickness ratio between the thickness Tb and the thickness Ts may be selected based software simulations. The software simulations may run simulations of cement operations in a well to optimize the thickness ratio based on an available clearness in the well and cyclic loads on the casing 100.

In one or more embodiments, the secondary layer 201 may be attached to the base layer 200 through any suitable manufacturing process, such as coating films, painting, blasting, chemically reacting/bonding, or other additive manufacturing processes, or any combination thereof. The secondary layer 201 may be made from a material selected from rubber or smart foam or a combination thereof. The rubber may be a fluoropolymer (e.g., AFLAS® or Viton®), a synthetic polymer (e.g., Butyl or Hypalon rubber), nitrile rubber, any type of rubber suitable for downhole conditions in a well, or a combination thereof. The smart foam may be a foam cement, Polyethylene (PE), Polyethylene (PU), or a combination thereof. It is further envisioned that insulation material may be added to the secondary layer 201.

Figure 2B:
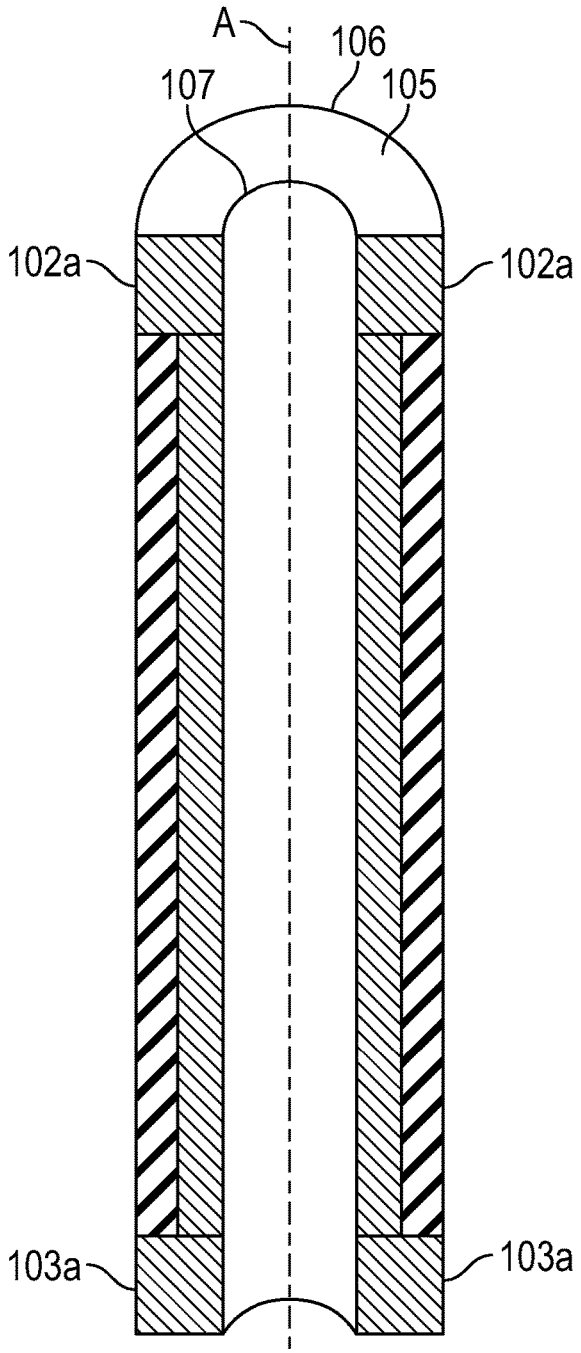

In FIG. 2B, a cross-sectional view taken along an axial plane Y in FIG. 1A is illustrated in accordance with the first embodiment. Thus, FIG. 2B is a side view of the casing of FIG. 1A. The joint connections 102*a*, 103*a* may be integral part of the base layer 200 such that the secondary layer 201 extends axially between the first joint connection 102*a* and the second joint connection 103*a*.

Figure 2C:
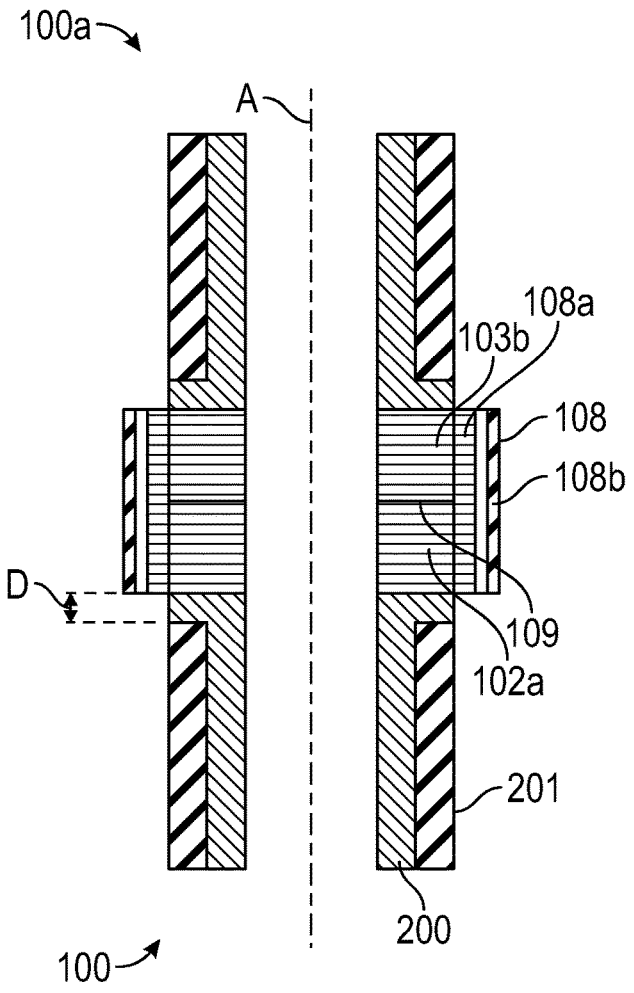

Referring to FIG. 2C, a close-up cross-sectional view of a first casing 100 connected to a second casing 100*a* is illustrated. Both the first casing 100 and the second casing 100*a* may be configured as described in FIGS. 2A and 2B. Additionally, the first casing 100 may be axially below the second casing 100*a*. For example, the first joint connection 102*a* of the first casing 100 may be connected to a second joint connection 103*b* of the second casing 100*a*. To connect the two joint connections 102, 103*b* together, a collar or coupling 108 may be used. The collar or coupling 108 may be a short cylindrical pipe with an inner connection surface 108*a*. The short cylindrical pipe may have a protective layer 108*b*. The protective layer 108*b* may be similar to the secondary layer 201 of the casings 100, 100*a*. The inner connection surface 108*a* may be threaded such that the inner connection surface 108*a* is coupled to the first joint connection 102*a* of the first casing 100 and the second joint connection 103*b* of the second casing 100*a*. For example, the collar or coupling 108 may first be installed on the first joint connection 102*a* of the first casing 100; then the first joint connection 102*a* of the first casing 100 may be coupled to the collar or coupling 108 until the first casing 100 and the second casing 100*a* are flush against each other forming a seal 109.

Still referring to FIG. 2C, the secondary layer 201 may be spaced a distance D from the first joint connection 102*a* such that the secondary layer 201 does not impede the collar or coupling 108.

Figure 2D:
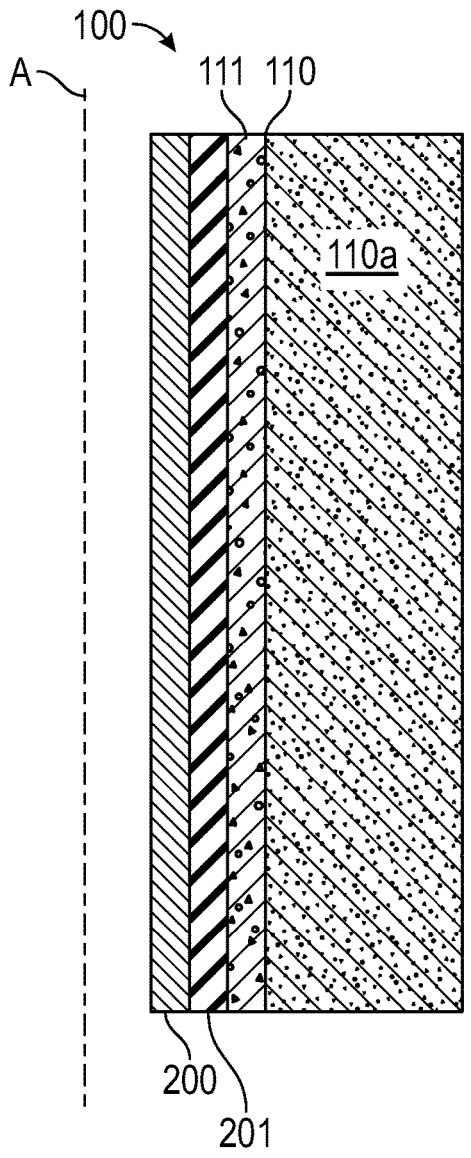

Now referring to FIG. 2D, a close-up cross-sectional view of the casing 100 as described in FIGS. 2A and 2B in a wellbore 110 of a formation 110*a* is illustrated. Additionally, cement 111 may be pumped into the wellbore 110 once the casing 100 in downhole. The cement 111 is pumped in an annulus space between the wellbore 110 and the casing 100. As shown by FIG. 2D, the secondary layer 201 of the casing 100 is between the cement 111 and the base layer 200 of the casing 100. With the secondary layer 201 between the base layer 200 and the cement 111, the secondary layer 201 may dampen a pressure or temperature exerted on the cement 111.

Figure 3A:
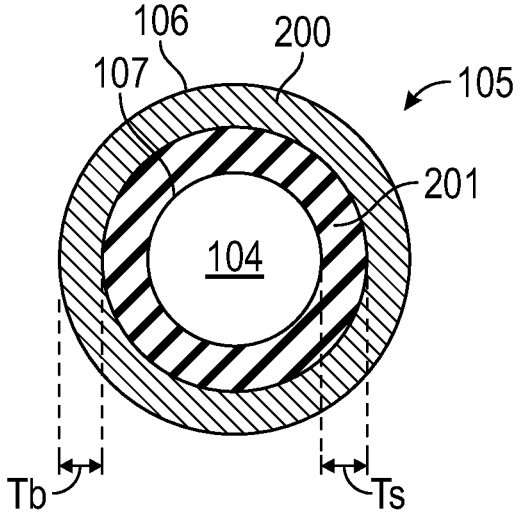
FIGS. 3A-3D are various cross-sectional views of casing of FIG. 1A in accordance with one or more embodiments disclosed herein.
Figure 3B:
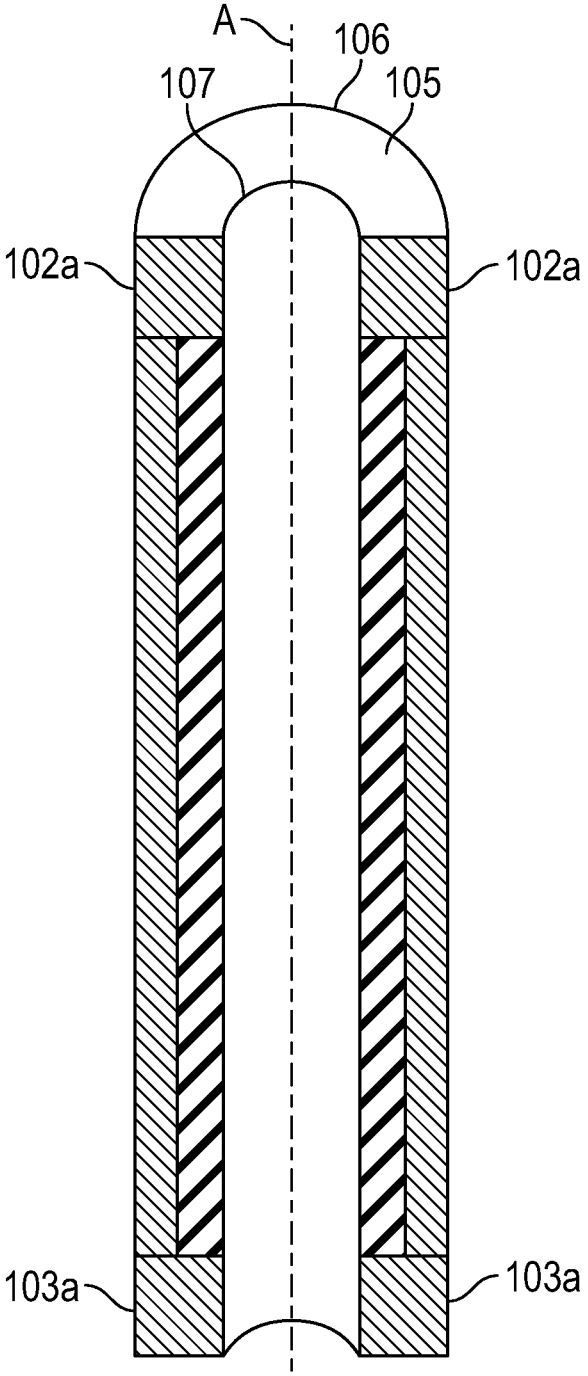
Figure 3C:
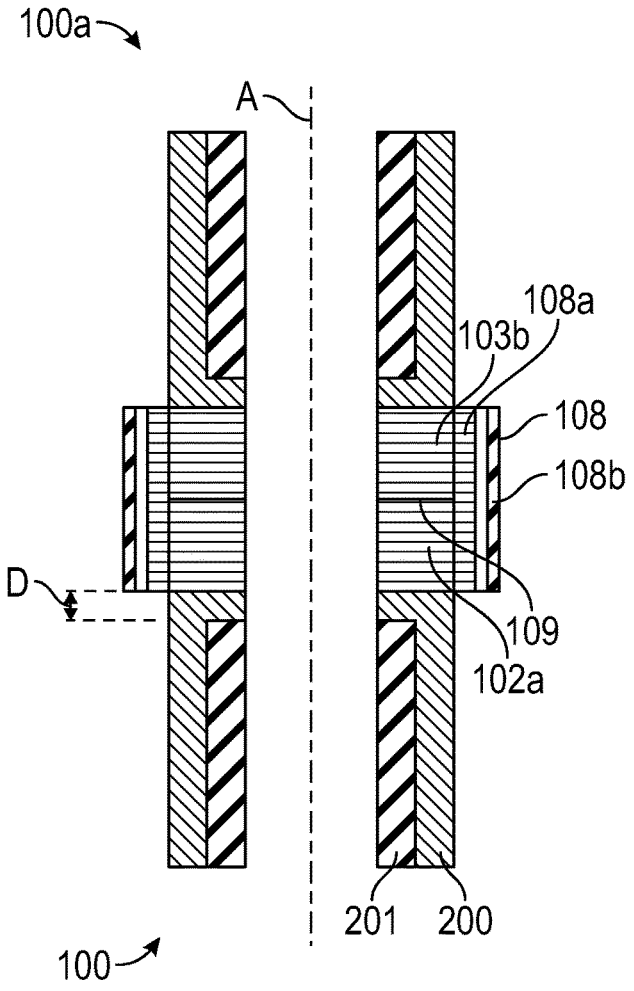
Figure 3D:
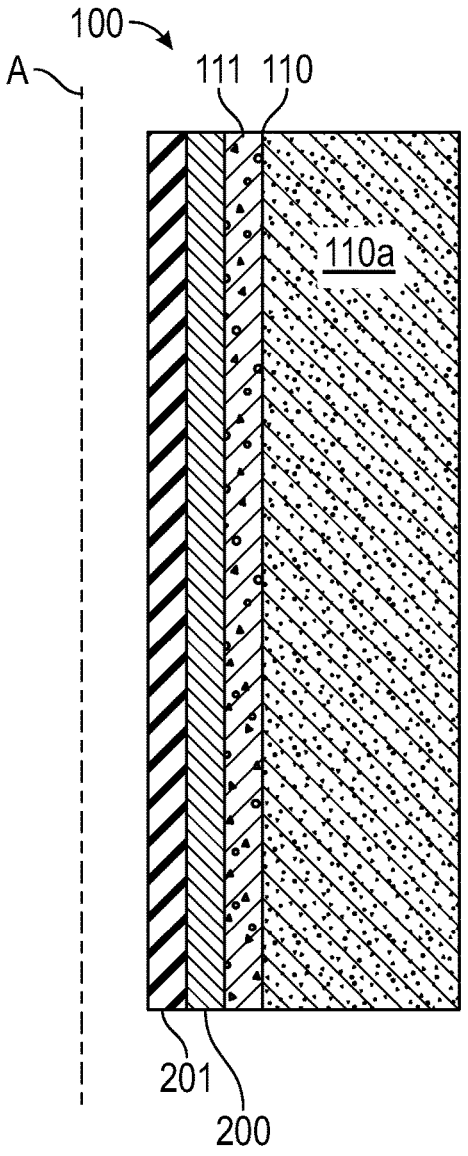

Referring now to FIGS. 3A-3D, a second embodiment of the casing 100 according to embodiments herein is illustrated, where like numerals represent like parts. FIGS. 3A-3D show an embodiment in which the secondary layer 201 is disposed internally, behind the base layer 200 of the casing. This is in contrast to the embodiment of FIG. 2A-2D, in which the secondary layer 201 is disposed externally, between the base layer 200 of the casing and the cement layer. In the second embodiment of FIGS. 3A-3D, the base layer 200 extends a thickness Tb radially inward from the outer surface 106 of the tubular body 101. Additionally, the secondary layer 201 extends a thickness Ts radially inward from the base layer 200 to the inner surface 107 of the tubular body 101. As shown in FIG. 3D, the base layer 200 is between the cement 111 and the secondary layer 201. With the secondary layer 201 behind the base layer 200, the secondary layer 201 may absorb and dampen internal pressure or temperature within the casing 100 before the pressure or temperature is transferred to the cement 111 through the base layer 200.

Referring now to FIGS. 4A-4D, a third embodiment of the casing 100 according to embodiments herein is illustrated, where like numerals represent like parts. The third embodiment of FIGS. 4A-4D is similar to that of the first embodiment of FIGS. 2A-2D. However, in the third embodiment, the base layer 200 extends a thickness Tb radially outwardly from the inner surface 107 to the outer surface 106 of the tubular body 101. Additionally, the secondary layer 201 may be embedded within the casing. More specifically, the secondary layer 201 may be embedded within the base layer 200 of the casing to have a thickness Ts less than the thickness Tb.

In the third embodiment, the base layer 200 may include a void 400 for the secondary layer 201 to be embedded within. The void 400 may extend an axial length to stop a distance D before the first joint connection 102*a*, as shown in FIG. 4C. For illustration purposes only, FIG. 4E illustrates the base layer 200 without the secondary layer 201 to better show the void 400. The void 400 may be an empty space that is formed between a first interior surface 401 and a second interior surface 402 in the base layer 200. The first interior surface 401 may be spaced from the second interior surface 402 a radial distance RD. The first interior surface 401 may be approximate to the inner surface 107 while the second interior surface 402 may be approximate to the outer surface 106. The first interior surface 401 and the second interior surface 402 may be coated or textured to improve attachment with the secondary layer 201 being inserted into the void 400. The radial distance RD may be equal to or greater than the thickness Ts of the secondary layer 201.

Figure 4A:
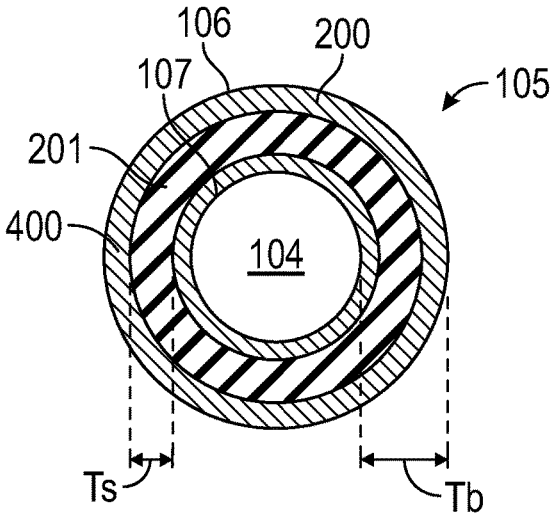
FIGS. 4A-4G are various cross-sectional views of casing of FIG. 1A in accordance with one or more embodiments disclosed herein.
Figure 4B:
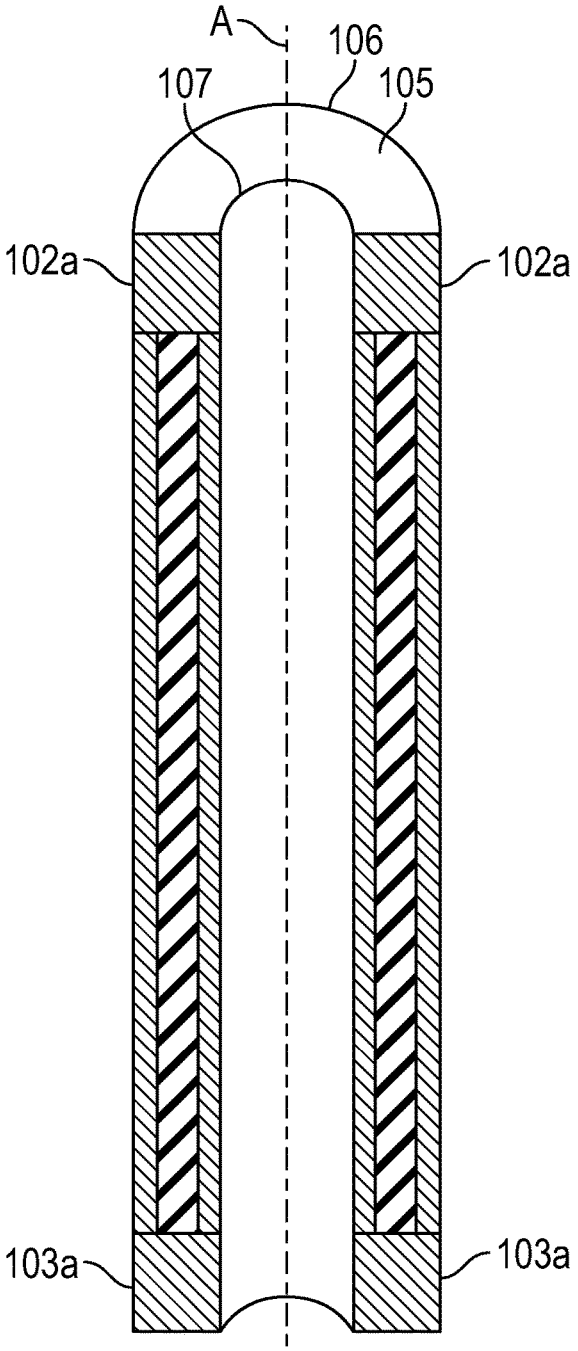
Figure 4C:
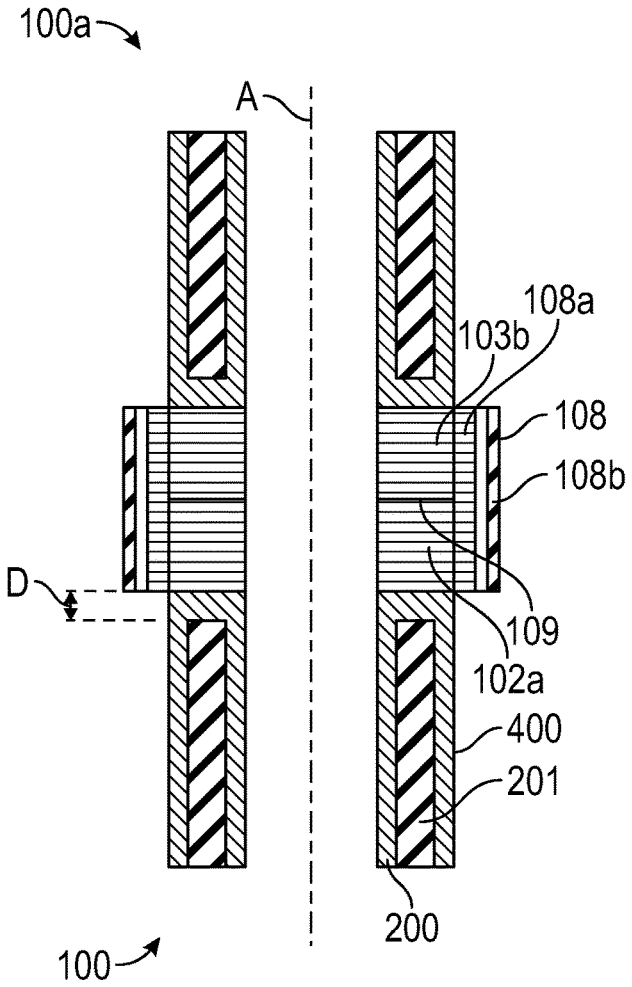
Figure 4D:
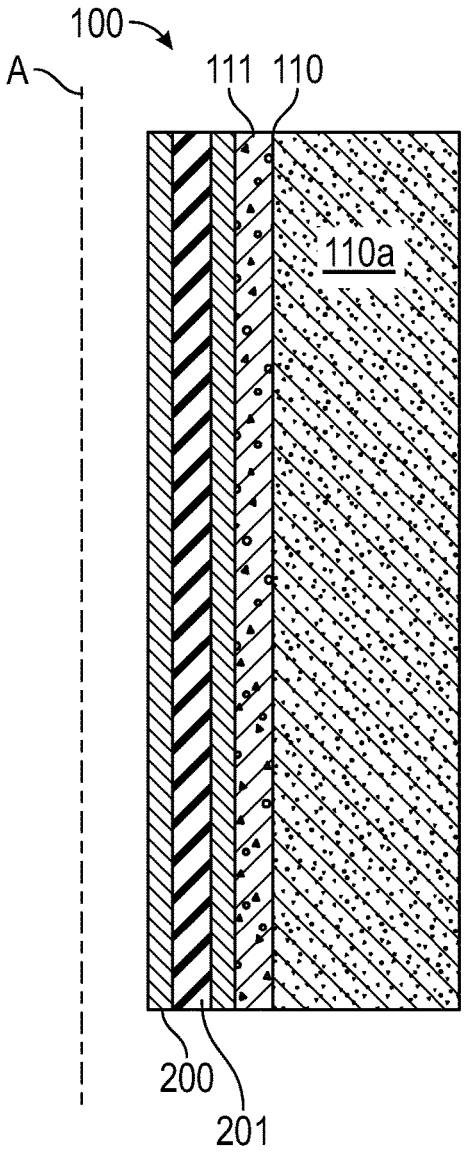
Figure 4E:
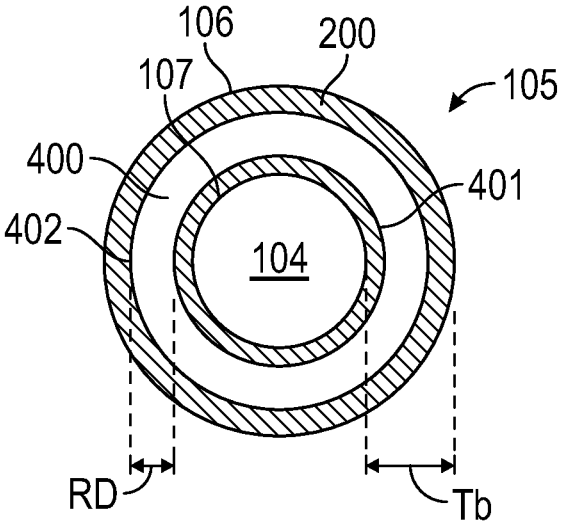

As shown by FIG. 4A, the secondary layer 201 may be inserted in the void 400 and attached to both the first interior surface 401 and the second interior surface 402 (see FIG. 4A). With the secondary layer 201 attached to both the first interior surface 401 and the second interior surface 402, the secondary layer 201 may fill the void 400 to allow absorption of pressure and temperature in the secondary layer 201 from the base layer 200. Additionally, the secondary layer 200 may prevent the base layer 200 from being permanently deformed.

Figure 4F:
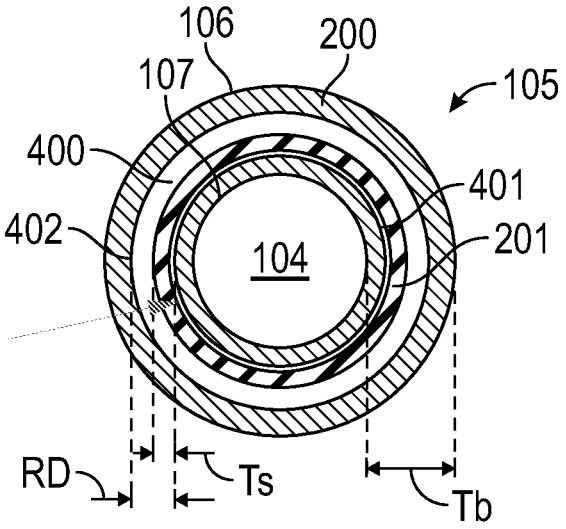

In FIG. 4F, a first variation of FIG. 4A is illustrated. The thickness Ts of the secondary layer 201 is less than the radial distance RD such that the secondary layer 201 may be attached to the first interior surface 401. With the secondary layer 201 attached to the first interior surface 401, a gap may be formed between the secondary layer 201 and the second interior surface 402 to allow for expansion and contraction of either the secondary layer 201 or the base layer 200.

Figure 4G:
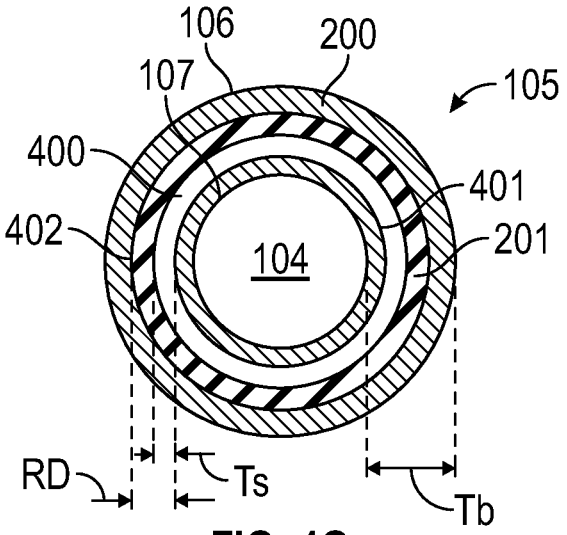

In FIG. 4G, a second variation of FIG. 4A is illustrated. The thickness Ts of the secondary layer 201 is less than the radial distance RD such that the secondary layer 201 may be attached to the second interior surface 402. With the secondary layer 201 attached to the second interior surface 402, a gap may be formed between the secondary layer 201 and the first interior surface 401 to allow for expansion and contraction of either the secondary layer 201 or the base layer 200.

Referring now to FIGS. 5A-5D, a fourth embodiment of the casing 100 according to embodiments herein is illustrated, where like numerals represent like parts. The fourth embodiment of FIGS. 5A-5D is similar to that of the third embodiment of FIGS. 4A-4D. However, in the fourth embodiment, the base layer 200 may include a plurality of secondary layers 201 embedded within a corresponding void 400. For example, each secondary layer 201 may have a corresponding void 400 separate from, each other. In some embodiments, two more secondary layers 201 may be one void 400. Each of the plurality of secondary layers 201 may have the same thickness Ts and be uniformly radially spaced from each other.

Figure 5A:
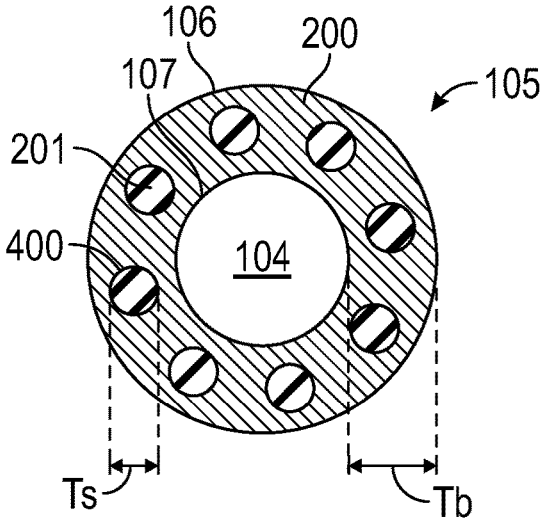
FIGS. 5A-5F are various cross-sectional views of casing of FIG. 1A in accordance with one or more embodiments disclosed herein.
Figure 5B:
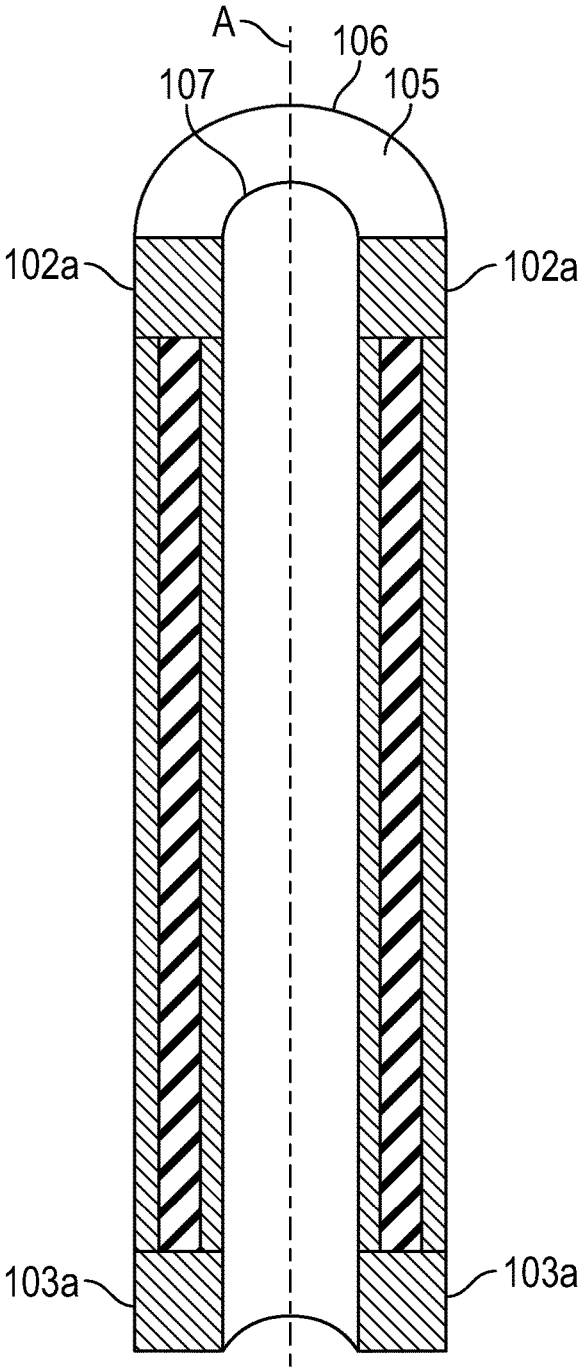
Figure 5C:
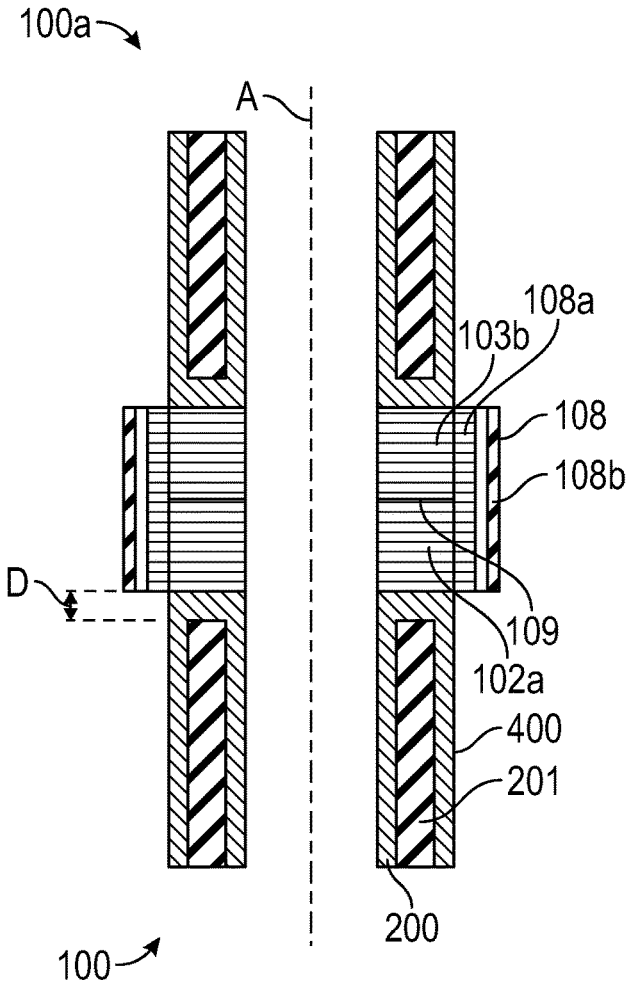
Figure 5D:
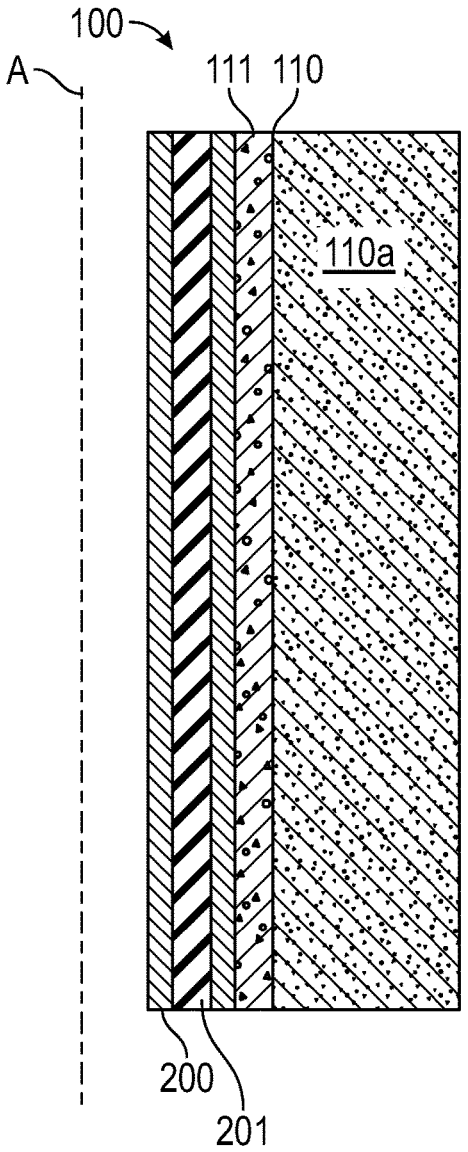
Figure 5E:
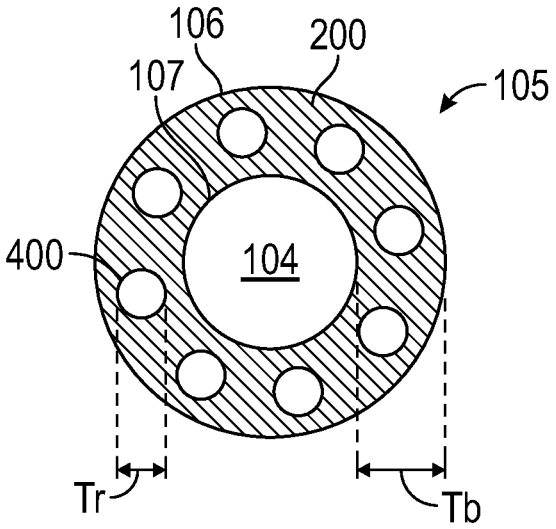
Figure 5F:
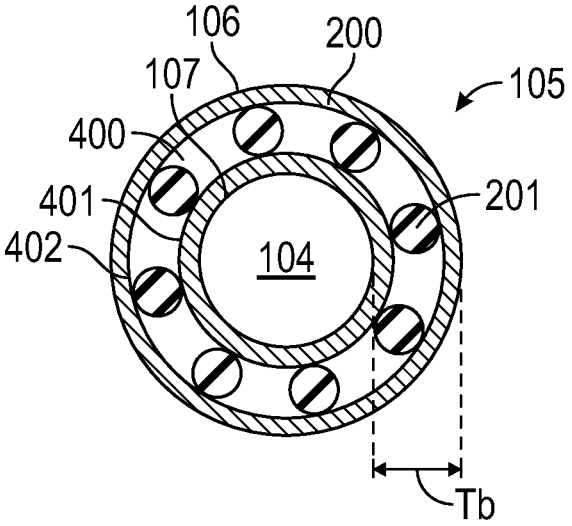

For illustration purposes only, FIG. 5E illustrates the base layer 200 without the secondary layer 201 to better show the corresponding voids 400. Each of the voids 400 may have a radial thickness Tr equal to or greater than the thickness Ts of each secondary layer 201. FIG. 5F illustrates a first variation of FIG. 5A; however, the base layer 100 may only have one void 400 (similar to that of FIG. 4A). In the one void 400, the plurality of secondary layers 201 may be embedded and attached to the first interior surface 401 and the second interior surface 402.

Figure 6:
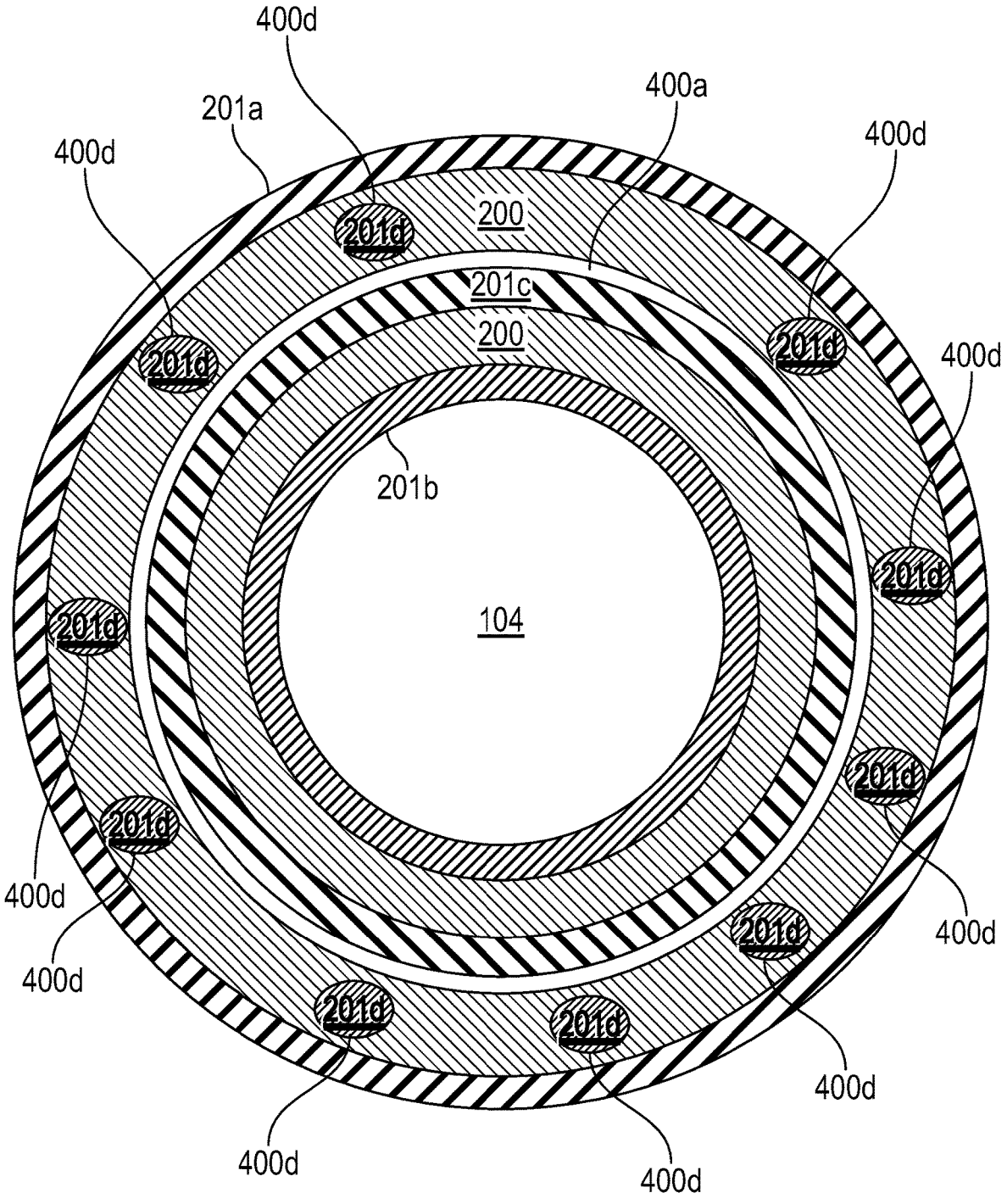
FIG. 6 is a cross-sectional view of casing of FIG. 1A in accordance with one or more embodiments disclosed herein.

Referring now to FIG. 6, a fifth embodiment of the casing 100 according to embodiments herein is illustrated, where like numerals represent like parts. FIG. 6 shows an embodiment in which any combination of the embodiments FIGS. 2A-5F may be used for two or more secondary layer 201*a*-201*d* attached to or embedded within the base layer 200. For example, a first secondary layer 201*a* may be disposed externally, between the base layer 200 of the casing and the cement layer and a second secondary layer 201*b* may be disposed internally, behind the base layer 200 of the casing. Additionally, a first void 400*a* may be provided within the base layer 200 with a third secondary layer 201*c* embedded in the void 400. Further, a second plurality of voids 400*d* may be provided within the base layer 200. Each void 400*d* may have a fourth second layer 201*d* embedded therein.

Figure 7:
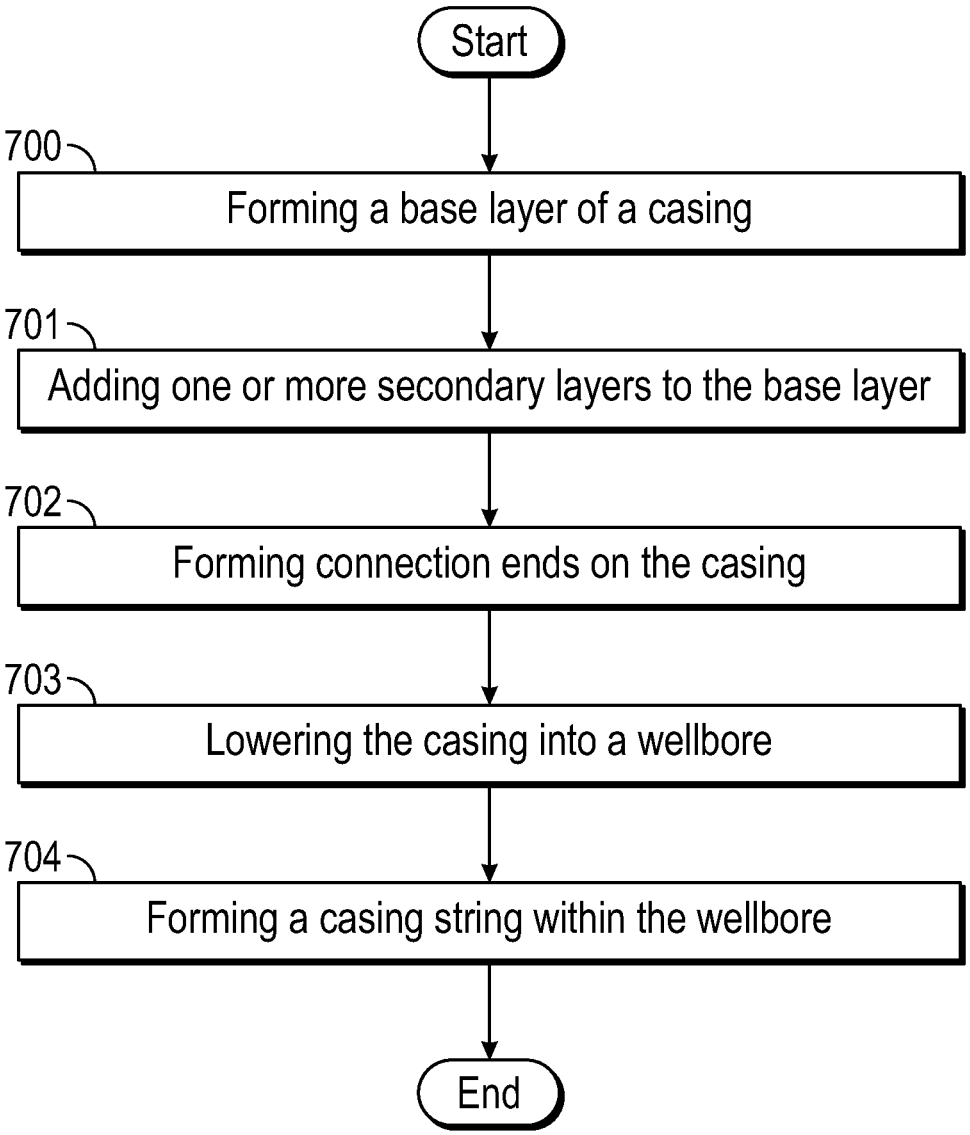
FIG. 7 is a flow chart of a method in accordance with one or more embodiments disclosed herein.

Now referring to FIG. 7, in one or more embodiments, FIG. 7 is a flowchart showing a method of manufacturing and using the casing 100 of FIGS. 2A-6. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 700, a base layer of the casing may be formed. The base layer may be formed by a wall of a tubular body extending axially a length from a first end to a second end. The wall may radially extend from an inner surface of the tubular body to an outer surface of the tubular body. Additionally, the tubular body may have a bore and be a seamless pipe. Further, the base layer of the casing may be formed by various manufacturing process such as mandrel mill process, plug mill process, forged pipe process, extrusion pipe process, or other types of pipe manufacturing. It is further envisioned, the base layer may be made from a material selected from iron, steel, stainless steel, metal alloy, plastic (e.g., polyvinyl chloride (PVC)), or any material suitable for downhole conditions in a well.

In some embodiments, the base layer may be formed with a void. The void may be an empty space within the base layer extending a radial distance between the inner surface of the tubular body and the outer surface of the tubular body. By including the void, the base layer may have a first interior surface and a second interior surface to delimit the empty space. In some embodiments, a plurality of voids may be provided within the base layer.

In Block 701, one or more secondary layers may be added to the base layer, thereby making up the wall of the casing. For example, the one or more secondary layers may be added to the outer surface and/or the inner surface of the base layer, or embedded within the void of the base layer, or a combination thereof. In some embodiments, the one or more secondary layers may be attached to the first interior surface and/or the second interior surface such that the one or more secondary layers is embedded within the base layer. It is further envisioned that simulations may be run to optimize a thickness ration between the base layer and the one or more secondary layers.

The one or more secondary layers may be added through any various manufacturing process, such as coating films, painting, blasting, chemically reacting/bonding, or other additive manufacturing processes, or any combination thereof. The one or more secondary layers may be made from a material selected from rubber or smart foam or a combination thereof. The rubber may be a fluoropolymer (e.g., AFLAS® or Viton®), a synthetic polymer (e.g., Butyl or Hypalon rubber), nitrile rubber, any type of rubber suitable for downhole conditions in a well, or a combination thereof. The smart foam may be a foam cement, Polyethylene (PE), Polyethylene (PU), or a combination thereof. With the one or more secondary layers added, an inner diameter and an outer diameter of the casing may be formed.

With the base layer and the one or more secondary layers formed, connection ends may be formed on the casing, as shown by Block 702. The connection ends may be provided at the first end and the second end of the casing. In addition, the connection ends may be provided on a portion of the base layer that does not have the one or more secondary layers. For example, the one or more secondary layers may stop a distance before the connection ends such that a gap may be formed between the one or more secondary layers and the connection ends. In one or more embodiments, the connection ends may be formed by a threading process such that threads are provided on the connection ends. The threads may be a buttress or round thread any type of thread. In some embodiments, the threads may be male threads such that both connection ends are male connections. Additionally, a collar or coupling may be threaded on one of the male connections. With connection ends formed, the casing may be transported to a well site.

At the wellsite, the casing may be lowered into the wellbore, as shown by Block 703. For example, the end of the casing without the collar or coupling may be at lowermost end to enter the wellbore first. Next, a second casing may be lowered onto the end of the casing with the collar or coupling. The second casing may be threaded onto the collar or coupling to form a seal with the casing. With the casing and the second casing coupled together, a casing string may be formed within the wellbore, as shown by Block 704. Furthermore, an upper most casing in the casing string may be hung from a wellhead via a linear hangar. With the casing string formed within the wellbore, cement operations may be conducted to cement the casing string to the wellbore.

In addition to the benefits described above, the casing described herein may provide further advantages such as a reduction in pressure magnitude transition to cement, thus, the casing may be a pressure dampening casing. Further, the casing described herein may also provide a reduction in temperature magnitude transition to cement, thus, the casing may be an insulator casing. By providing the casing with one or more secondary layers, a well-life of cement in a wellbore may be increased as the one or more secondary layers shields the cement from an expansion and contraction of the casing. With the one or more secondary layers attached to and/or embedded within a wall of the casing, the one or more secondary layers may act as a protective layer, a mechanical insulator, and a fluid barrier for the casing. Further, the one or more secondary layers may have an elasticity to allow deformation and absorption based on external or and/or internal forces on the casing. One skilled in the art will appreciate how the one or more secondary layers may be integral to the casing in all embodiments described herein.

While the method and apparatus have been described with respect to a limited number of embodiments, those skilled in the art, having benefit of this disclosure, will appreciate that other embodiments can be devised which do not depart from the scope as disclosed herein. Accordingly, the scope should be limited only by the attached claims.

What is claimed is:

1. A casing comprising:

a tubular body formed by a wall extending axially from a first end to a second end, the tubular body having a bore therein throughout, the wall radially extending from an inner surface of the tubular body to an outer surface of the tubular body, wherein the wall comprises:

a base layer; and one or more secondary layers embedded within a void of the base layer, wherein the one or more secondary layers is a rubber or smart foam, wherein the one or more secondary layers is attached to a first interior surface of the base layer and a gap is formed between the one or more secondary layers and a second interior surface of the base layer, or wherein the one or more secondary layers is attached to the second interior surface and the gap is formed between the one or more secondary layers and the first interior surface.

2. The casing of claim 1, wherein the base layer radially extends from the inner surface to the outer surface.

3. The casing of claim 1, wherein the rubber or smart foam is a fluoropolymer, a synthetic polymer, a nitrile rubber, a foam cement, Polyethylene (PE), Polyurethane (PU), or a combination thereof.

4. The casing of claim 1, wherein the secondary layer attached to the base layer by an additive manufacturing process.

5. The casing of claim 1, wherein the base layer is metal or plastic, and the metal is iron, steel, stainless steel, or metal alloy, and the plastic is polyvinyl chloride.

6. The casing of claim 1, wherein the first end and the second end include a joint connection.

7. The casing of claim 6, wherein the secondary layer axially extends a length between the first end and the second end.

8. A casing string comprising:

a first casing coupled to a second casing, wherein the first casing is axially below the second casing, wherein the first casing comprises:

a first tubular body formed by a first wall extending axially from a first end to a second end, the first tubular body having a first bore therein throughout, the first wall radially extends from a first inner surface of the first tubular body to a first outer surface of the first tubular body, wherein the first wall comprises:

a first base layer; and one or more first secondary layers embedded within a void of the first base layer, wherein the one or more first secondary layers is a rubber or smart foam, wherein the one or more secondary layers is attached to a first interior surface of the base layer and a gap is formed between the one or more secondary layers and a second interior surface of the base layer, or wherein the one or more secondary layers is attached to the second interior surface and the gap is formed between the one or more secondary layers and the first interior surface, wherein the second casing comprises:

a second tubular body formed by a second wall extending axially from a third end to a fourth end, the second tubular body having a second bore therein throughout, the second wall radially extends from a second inner surface of the second tubular body to a second outer surface of the second tubular body, wherein the second wall comprises:

a second base layer; and one or more second secondary layers embedded within a second void of the second base layer, wherein the one or more second secondary layers is a rubber or smart foam, wherein the one or more second secondary layers is attached to a third interior surface of the second base layer and a second gap is formed between the one or more second secondary layers and a fourth interior surface of the second base layer, or wherein the one or more second secondary layers is attached to the fourth interior surface and the second gap is formed between the one or more second secondary layers and the third interior surface; and a collar or coupling configured to couple the second end of the first casing to the third end of the second casing.

9. The casing string of claim 8, wherein the casing string is hanging within a wellbore.

10. The casing string of claim 9, further comprising a cement slurry between the casing string and the wellbore.

11. The casing string of claim 10, wherein the one or more first secondary layers of the first casing and the one or more second secondary layers of the second casing are configured to dampen a pressure or temperature being exerted on the cement slurry from the first casing and the second casing.

12. A method comprising:

forming a base layer of a tubular body extending axially from a first end to a second end;

providing one or more voids within the base layer, wherein the one or more voids is an empty space extending a radially distance between a first interior surface of the base layer and a second interior surface of the base layer;

embedding one or more secondary layers within the one or more voids, wherein the one or more secondary layers is a rubber or smart foam, wherein embedding the one or more secondary layers comprises attaching the one or more secondary layers to the first interior surface to form a gap between the one or more secondary layers and the second interior surface or attaching the one or more secondary layers to the second interior surface to form the gap between the one or more secondary layers and the first interior surface.

13. The method of claim 12, further comprising providing a connection end at the first end and the second end.

14. The method of claim 13, further comprising stopping the one or more secondary layers a distance before the connection ends.

15. The method of claim 13, further comprising threading a collar or coupling to the connection end at the first end or the second end.

* * * * *